US005113556A

United States Patent [19]

Murai et al.

[11] Patent Number: 5,113,556

[45] Date of Patent: May 19, 1992

[54] BUCKLE

[75] Inventors: Ryukichi Murai, Toyama, Japan; Masaaki Endo, Dietzenbach, Fed. Rep. of Germany

[73] Assignee: Yoshida Kogyo, K.K., Tokyo, Japan

[21] Appl. No.: 608,698

[22] Filed: Nov. 5, 1990

[30] Foreign Application Priority Data

Nov. 10, 1989 [JP] Japan ..... 1-131426[U]
Apr. 27, 1990 [JP] Japan ..... 2-45427[U]

[51] Int. Cl.[5] ..... A44B 11/25
[52] U.S. Cl. ..... 24/633; 24/615
[58] Field of Search ..... 24/633, 606, 614, 615, 24/635, 640, 641, 645, 647

[56] References Cited

U.S. PATENT DOCUMENTS

| | | | |
|---|---|---|---|
| 4,679,282 | 7/1987 | Feng | 24/615 X |
| 4,802,262 | 7/1989 | Kasai | 24/633 X |
| 4,831,694 | 5/1989 | Kong | 24/606 X |
| 4,866,819 | 9/1989 | Kasai | 24/633 X |
| 4,977,650 | 12/1990 | Ida | 24/633 X |
| 4,999,886 | 3/1991 | Kasai | 24/633 |

*Primary Examiner*—Laurie K. Cranmer

*Attorney, Agent, or Firm*—Hill, Van Santen, Steadman & Simpson

[57] ABSTRACT

A buckle for connecting the ends of a belt used in clothes and the like. The buckle consists of a socket, which has a hollow socket-body and a locking-device, and a plug, which as a pair of engaging members. The locking device has a locking-plate and a pressuring projection. A resilient engaged member is provided in the socket-body so as to be engaged to and disengaged from the engaging members of the plug. According to this buckle, when the pressuring projection is located at the bottom shell-side, even if the locking-plate is pressured, the locking-plate and the resilient engaged member are provided so as not to be brought into contact each other resulting in ensuring the engagement of the plug and the socket. On the other hand, when the locking device is slid to the plug-side, if the locking-plate is pressure, since the pressuring projection can be brought into contact with the resilient engaged member, this member is deformed resiliently, thereby the engaging members disengage from the resilient engaged member resulting in removing the plug from the socket in easy operation.

5 Claims, 7 Drawing Sheets

1
14
32
34
33
10
11
12
13
15
16
17
19
20
21
22
23
27
28
29
30
30a
35
36
40
41
42
43

BUCKLE

BACKGROUND OF THE INVENTION

1. Field of the Invention

This invention relates to a buckle molded out of a synthetic resin material for connecting the ends of a belt used in clothes, a bag and a flask and the like, particular to a buckle provided with a locking device.

2. Prior Art

A buckle provided with a locking device shown in Japanese Utility Model Publication No. 57-13305 was known in prior art. This buckle composes a hollow socket and a plug, which is to be inserted into and engage to the socket. Then, a pair of resilient legs are provided in the plug so as to be parallel each other. Further, a locking device is provided so as to be slid in the socket in order to prevent the pair of resilient legs from being deformed resiliently. However, according to this conventional buckle, in order to remove the plug from the socket, the pair of resilient legs must be deformed resiliently so as to be pinched towards each other, while the locking device must be pushed toward the socket. That is to say, this removing operation should be performed with both hands, which is inconvenient in its operation.

Further, the locking device has no mechanism for locating the locking device at a locked position and an unlocked position for locking the plug to the socket and for removing the plug from the socket respectively. Therefore, when the plug engages to the socket for connecting the belts with this buckle, this locking device is apt to be open. Additionally, since this locking device is formed within the socket, the socket is required to be a large size.

SUMMARY OF THE INVENTION

It is therefore the object of the present invention to provide a small sized and cheap buckle, which permits easy operation with a locking device for engaging and disengaging between the plug and the socket with a single hand and by which the locking device can be kept at a locked position due to a spring mechanism.

A buckle related to the present invention consists of a socket and a plug. Then, the socket consists of a hollow socket-body and a locking device. The plug resiliently engages to and disengages to be removed from the socket-body.

The socket-body is built up with an inlet, a front shell, a rear shell, a bottom shell and side shells. Then, the socket-body has a resilient pressuring member formed along the peripheral portion of the front shell of the hollow socket-body so as to form a U-shaped slit. Additionally, the socket-body has a resilient engaged member, which is projected from the inlet-side of the rear shell toward the bottom shell so as to be extended in a hollow chamber in the socket-body and which has an engaged portion at its fore end portion.

On the other hand, the plug is built up with a plug-body and a pair of engaging members. The engaging members are extended from the plug-body toward the socket-body so that, between the engaging members, there is a space being larger than the largest width of the pressuring projection of the locking device. Further, the engaging members have engaging portions at their fore end portions respectively.

The locking device comprises of a locking-plate and a thick pressuring projection, which is projected from the center of the bottom shell-side end portion of the rear face of the locking-plate. This locking device is attached to the resilient pressuring member, while the locking device, the plug and the socket-body are moved relationally as follows;

When the pressuring projection of the locking device is located at the bottom shell-side, even if the locking-plate is pressured toward the resilient engaged member, the pressuring projection can not be brought into contact with the resilient engaged member. On the other hand, only when the locking-plate is slid to the inlet-side and is pressured toward the resilient pressuring member, the pressuring projection can be brought into contact with the resilient engaged member to deform resiliently the resilient engaged member toward the rear shell for removing the plug from the socket.

That the pressuring projection is located at the bottom shell-side means that the locking device is located at a locked position. On the other hand, that the locking-plate is slid to the inlet-side means that the locking device is located at an unlocked position.

In this buckle, when the plug engages to the socket, even if the locking-plate is pressured toward the rear shell-side, the pressuring projection of the locking device and the resilient engaged member of the socket-body are provided so as not to be brought into contact each other. Accordingly, the resilient engaged member is not deformed resiliently so that the engaging members of the plug do not disengage from the resilient engaged member. As a result, the engagement of the plug and the socket can be ensured.

For unlocking the above mentioned locked engagement, the locking-plate is slid toward the inlet-side, while the pressuring projection of the locking device moves toward the inlet through the space formed between the engaging members. Thus, the pressuring projection is brought into contact with the resilient engaged member. Then, the locking-plate is pressured so that the resilient pressuring member can be deformed resiliently. The resilient engaged member is deformed resiliently toward the rear face of the socket due to the contact of the pressuring projection and the resilient engaged member. Accordingly, the engaging member of the plug disengages from the resilient engaged member of the socket. As a result, the plug can be removed from the socket.

Further objects and advantages of the present invention will be apparent from the following description, reference being had to the accompanying drawing wherein preferred embodiments of the present invention are clearly shown.

DESCRIPTION OF THE PREFERRED EMBODIMENT

Figures 1, 2:
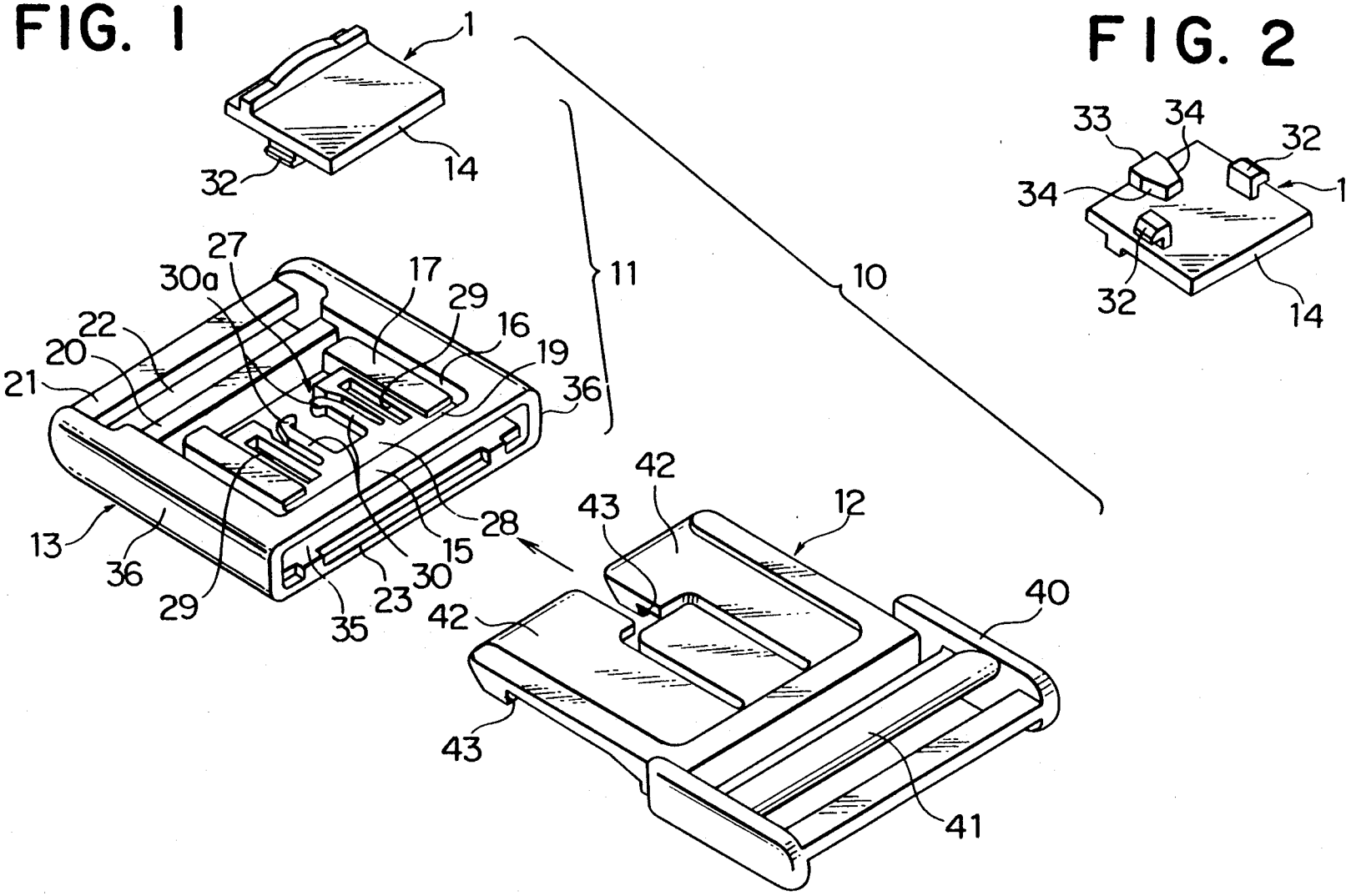
FIG. 1 is an exploded perspective view showing an embodiment of a buckle related to the present invention.
FIG. 2 is a perspective view of a locking device viewed from its rear side.
Figure 3:
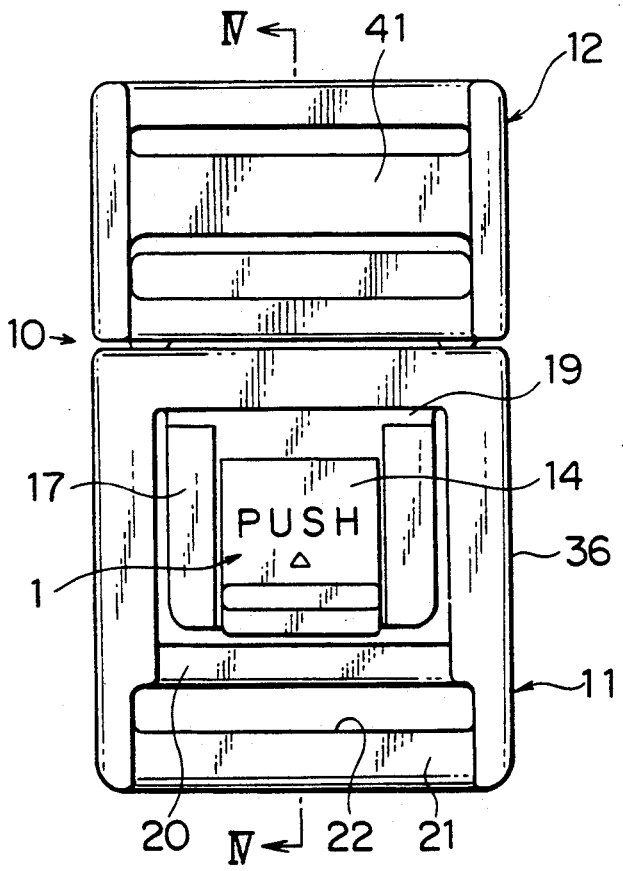
FIG. 3 is an elevational view of a buckle.
Figure 4:
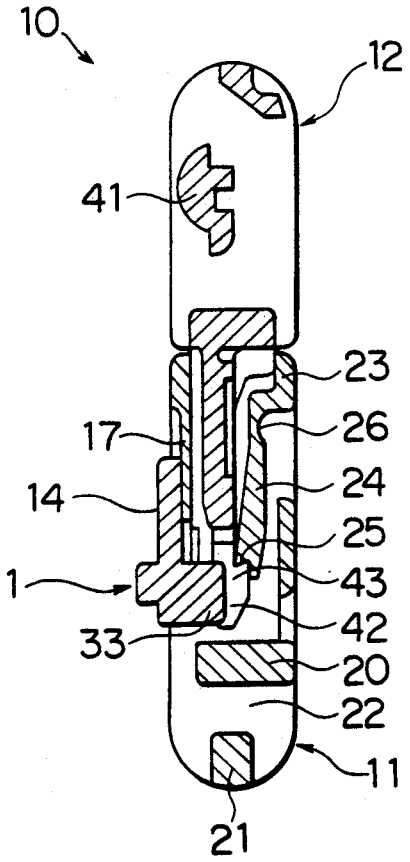
FIG. 4 is a cross sectional view taken on line IV—IV of FIG. 3.
Figure 5:
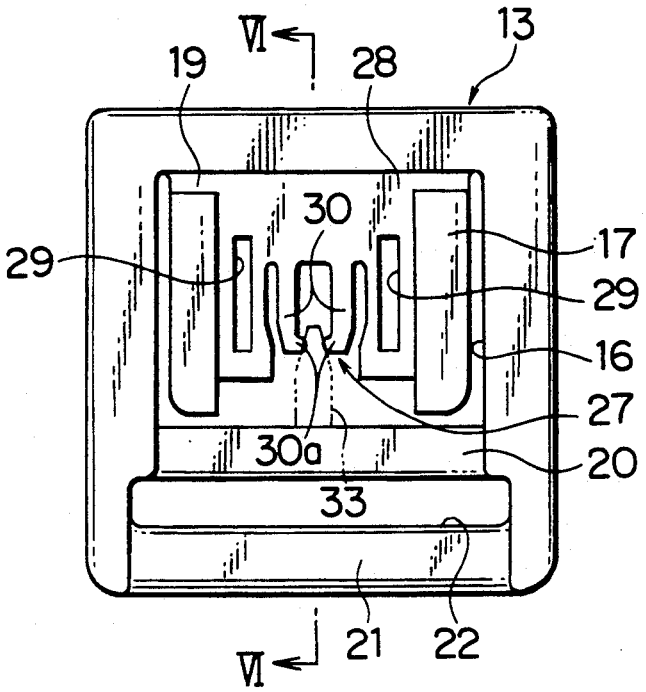
FIG. 5 is an elevational view of a socket-body.
Figure 6:
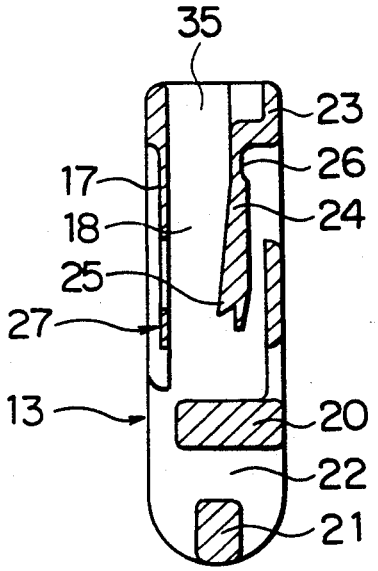
FIG. 6 is a cross sectional view taken on line VI—VI of FIG. 5.

Now, the present invention is described more particularly referring to figures for first embodiment.

FIGS. 1, 2, 3 and 4 show a buckle 10 related to the present invention. The buckle 10 is molded out of a synthetic resin material and consists of the socket 11 and the plug 12 which can engage to be removed from the socket 11.

Then, the socket 11 consists of a socket-body 13 and a locking device 1 to be attached to the socket-body 13.

This socket-body 13 has a hollow-shape and is built up with an inlet 35, a front shell 15, a rear shell 23, a bottom shell 20 and side shells 36, 36. Further, the socket-body 13 has a tongue-shaped resilient pressuring member 17 formed along the peripheral portion of the front shell 15 so as to form a U-shaped slit 16. A hollow chamber 18 is formed in the socket-body 13. This resilient pressuring member 17 has a thin deforming portion 19, which is deformed resiliently toward the chamber 18. The bottom shell 20 is disposed so as to be slightly lower than the resilient pressuring member-side face of the front shell 15. Numeral 21 is a bar for attaching a belt. An opening 22 in which the belt is inserted is formed between the bar 21 and the bottom shell 20. A resilient engaged member 24 is projected from the inlet-side of the rear shell 23 integrally toward the bottom shell 20 to be extended in the hollow chamber 18. A bevelled engaged portion 25 is formed at the fore end portion of the resilient engaged member 24. Then, a groove 26 is formed transversely at the plug-side end portion of the resilient engaged member 24 so that this resilient engaged member 24 is thin there. The center portion of the above mentioned resilient pressuring member 17 is formed to be a thin guide-plate 28. A pair of opposed long guide-holes 29, 29 are provided at the both sides of the guide-plate 28. Although, in this figure, there are the pair of guide-holes 29, 29, single guide-hole 29 can be provided at either side.

Figure 7:
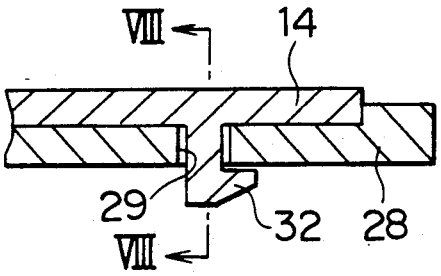
FIG. 7 is an expanded sectional view of a locking device engaging to a socket-body.
Figure 8:
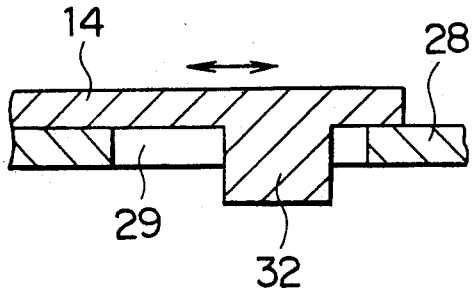
FIG. 8 is a cross sectional view taken on line VIII—VIII of FIG. 7.
Figure 9:
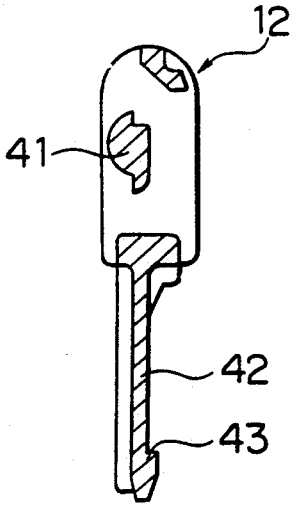
FIG. 9 is a longitudinal cross sectional view of a plug.

As shown in FIG. 2, the locking device 1 comprises of a locking-plate 14, a pair of engaging guide-hooks 32, 32 and a pressuring projection 33. The pair of engaging guide-hooks 32, 32 are provided at the both sides on the rear face of the locking-plate 14 so that the engaging guide-hooks 32, 32 correspond to the pair of guide-holes 29, 29 of the socket-body 13. If just a single guide-hole 29 is provided, just one engaging guide-hook 32 is enough. Since this locking device 1 is molded out of the synthetic resin, by pushing the engaging guide-hooks 32, 32 into the guide-holes 29, 29 respectively, the engaging guide-hooks 32, 32 are deformed resiliently so as to fit and engage to the guide-holes 29, 29 respectively. That is to say, as shown in FIG. 7, the locking device 1 can be attached to the guide-plate 28 of the resilient pressuring member 17 by this simple movement. As shown in FIG. 8, attached locking device 1 can be slid along the guide-holes 29, 29. The thick pressuring projection 33 is projected from the center of the bottom shell-side end portion of the rear face of this locking-plate 14 toward the socket-body 13 for pressuring the resilient engaged member 24 of the socket-body 13.

The pressuring projection 33 of the locking device 1 has side faces 34, 34 which are opposed and tapered toward the engaging guide-hooks 32, 32 respectively. On the other hand, a pair of resilient legs 30, 30 are formed at the center of the guide-plate 28 of the socket-body 13 so as to be opposed each other to be U-shaped and form a space with an open at the bottom shell-side. At the fore ends of the resilient legs 30, 30, a pair of resilient claws 30*a*, 30*a* are formed respectively. Then, the pressuring projection 33 is pushed into and stays at the space between the pair of resilient legs 30, 30, while the pair of resilient claws 30*a*, 30*a* are brought into contact with the side faces 34, 34 respectively and the resilient legs 30, 30 are deformed resiliently. That is to say, a spring mechanism 27 is provided by the co-operation of the pair of resilient legs 30, 30 and the side faces 34, 34 of the pressuring projection 33. As a result, the locking device 1 can be always pressured toward the bottom shell 20 by the spring mechanism 27.

The plug 12 is built up with a ring-shaped plug-body 40 and a pair of engaging members 42, 42. The plug-body 40 is provided with, between its both sides, a bar 41 for attaching the belt. The pair of engaging members 42, 42 are extended integrally from the fore end portion of the plug-body 40 toward the socket-body 13 so that, between the engaging members 42, 42, there is a space being larger than the largest width of the pressuring projection 33 of the locking device 1. Further, between the engaging members 42, 42, a center portion is disposed so as to form a Y-shaped slit. Bevelled engaging portions 43, 43 are formed at the rear faces of the fore end portions of the engaging members 42, 42 respectively, so as to engage to the above mentioned bevelled engaged portion 25 of the resilient engaged member 24 of the socket-body 13.

That the pressuring projection 33 is located at the bottom shell-side means that the locking device 1 is located at a locked position. On the other hand, that the locking-plate 14 is slid to the inlet-side means that the locking device 1 is located at an unlocked position.

Figure 10:
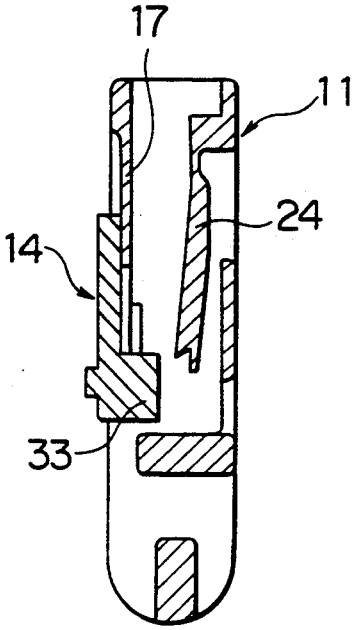
FIGS. 10 and 11 are cross sectional views of a socket showing operation with a locking device.

In this buckle 10, by inserting the engaging members 42, 42 of the plug 12 from the inlet 35 of the socket 11, the engaging portions 43, 43 of the above mentioned engaging members 42, 42 engage to the engaged portion 25 of the resilient engaged member 24. Therefore, as shown is FIG. 4, the plug 12 engages to the socket 11 so as to be set at a predetermined position in the socket-body 13. The locking device 1 is always pressured toward the bottom shell 20 by the above mentioned spring mechanism 27. Then, even if the locking-plate 14 is pressured by hands and the like toward the resilient engaged member 24 of the socket-body 13, the resilient engaged member 24 can not be deformed resiliently toward the rear shell 23 of the socket-body 13, because the pressuring projection 33 of the locking device 1 and the resilient engaged member 24 of the socket-body 13 are provided so as not to be brought into contact each other. Therefore, the engaging members 42, 42 do not disengage from the resilient engaged member 24 so that the plug 12 can be kept in the socket-body 13, while the plug 12 engages to the socket 11 (this situation of the socket 11 is shown in FIG. 10). As explained above, by only inserting of the plug 12 into the socket 11 until the engaging portions 43, 43 engage to the engaged portion 25, the engagement of the plug 12 and the socket 11 can be performed automatically. Therefore, this buckle 10 is very convenient in its operation.

Figure 11:
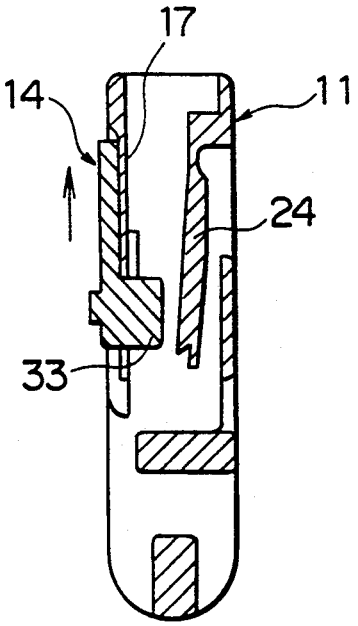
Figure 12:
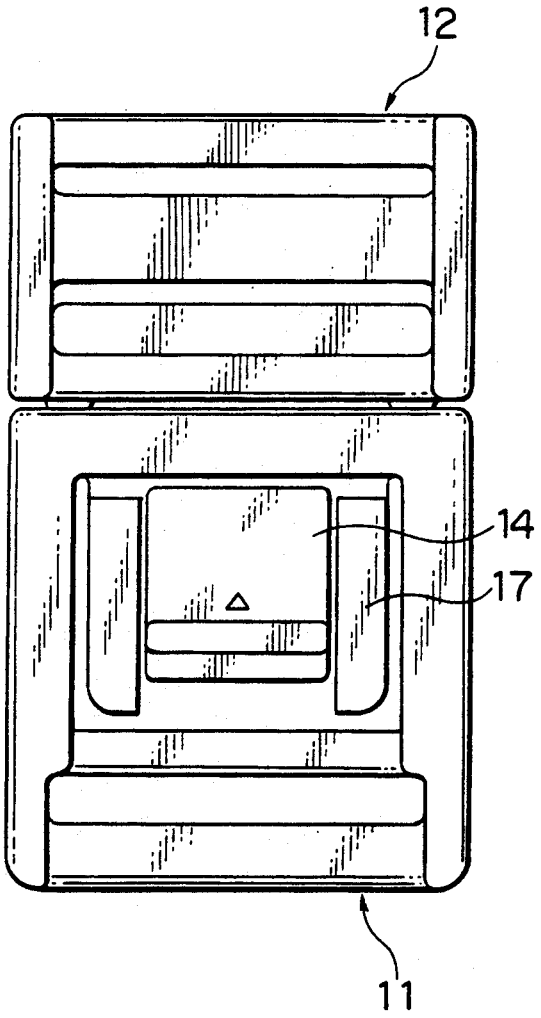
FIG. 12 is an elevational view showing disengaging operation of a buckle.

Next, for removing the plug 12 from the socket 11, as shown in FIGS. 11 and 12, the locking-plate 14 is slid to the inlet-side, while the pressuring projection 33 of the locking device 1 moves toward the inlet 35 through the space formed between the engaging members 42, 42. Then, the pressuring projection 33 of the locking device 1 can be brought into contact with the resilient engaged member 24. The locking-plate 14 is pressured toward the resilient engaged member 24 of the socket-body 13, thereby, the resilient pressuring member 17 is deformed resiliently toward the resilient engaged member 24 of the socket-body 13 and simultaneously, the pressuring projection 33 of the locking device 1 presses the resilient engaged member 24 toward the rear shell 23 of the socket body 13. Therefore, the resilient engaged member 24 is deformed resiliently toward the rear shell 23 of the socket-body 13 so that the engaging portions 43, 43 of the engaging members 42, 42 of the plug 12 disengage from the engaged portion 25 of the resilient engaged member 24 of the socket-body 13. As a result, the plug 12 can be removed from the socket 11.

Figure 13:
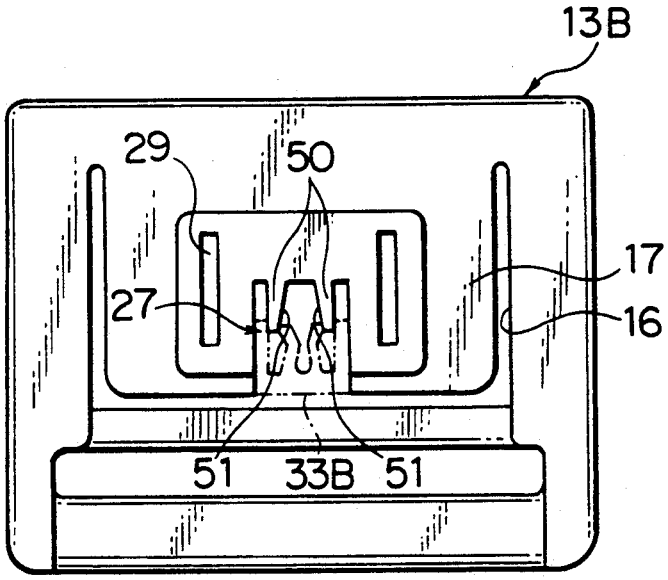
FIG. 13 is an elevational view of a socket base showing another embodiment.
Figure 14:
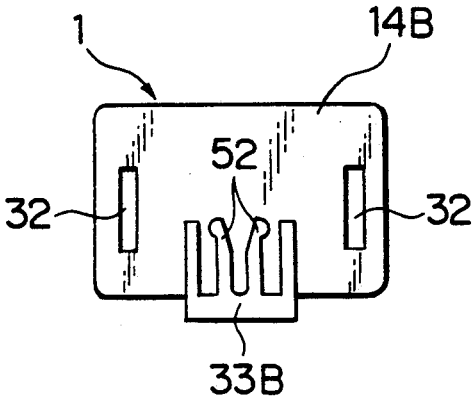
FIG. 14 is an elevational view of a locking device of another embodiment viewed from its rear side.
Figure 15:
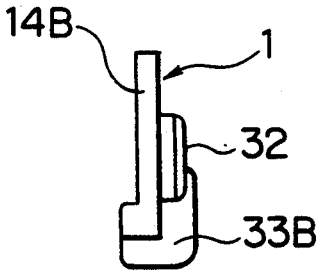
FIG. 15 is a side view from left side of FIG. 14.

FIG. 13 shows another embodiment of the spring mechanism 27 of a socket 11B. A notch 50 is formed at the center of a socket-body 13B so as to be V-shaped and has inner side faces 51, 51 which are tapered toward the inlet 35 of the socket-body 13B. As shown in FIGS. 14 and 15, in order to correspond them, a pair of resilient legs 52, 52 are formed in a thick pressuring projection 33B provided on the rear face of the locking-plate 14B of a locking device 1B so as to be parted away toward the engaging guide-hooks 32, 32 respectively. The spring mechanism 27 is provided by the co-operation of the pair of resilient legs 52, 52 and the inner side faces 51, 51. Then, the pair of resilient legs 52, 52 are pushed into a space formed between the inner side faces 51, 51 and stays there, while the fore end portions of the resilient legs 52, 52 are brought into contact with the inner side faces 51, 51 respectively and the pair of resilient legs 52, 52 are deformed resiliently. As a result, the locking device 1B can be always pressured toward the bottom shell 20 by the spring mechanism 27.

Next, another embodiment of the socket 11A related to the present invention, which permits more convenient operation, will be explained referring to FIGS. 16, 17 and 18.

In the socket-body 13, 13B of the above mentioned embodiments, the resilient pressuring member 17 can be deformed resiliently toward the resilient engaged member 24 of the socket-body 13, 13B with regardless to the position of the locking device 1, 1B. Therefore, when the locking-plate 14, 14B is slid to the inlet-side by hands for unlocking, if the locking-plate 14, 14B was pressured too much, the locking device 1, 1B would displace toward the resilient engaged member 24 of the socket-body 13, 13B before finishing the sliding of the locking-plate 14, 14B, thereby, while the locking device 1, 1B is displaced, this locking-plate 14, 14B might be slid. In this case, the pressuring projection 33, 33B of the locking device 1, 1B stops at the fore end portion of the resilient engaged member 24. Accordingly, the locking-plate 14, 14B can not be slid to the predetermined unlocked position, where the locking-plate 14, 14B can pressure the resilient engaged member 24 for unlocking. In order to solve this problem, a user must adjust his power applied to the locking-plate 14, 14B with a suitable balance between the pressuring power and the sliding power so that, while the locking device 1, 1B is not displaced, the locking-plate 14, 14B can be slid until the predetermined unlocked position. Then, the pressuring power applied to the locking-plate 14, 14B is increased. This operation requires skilled technique to some degree and is inconvenient.

Figure 16:
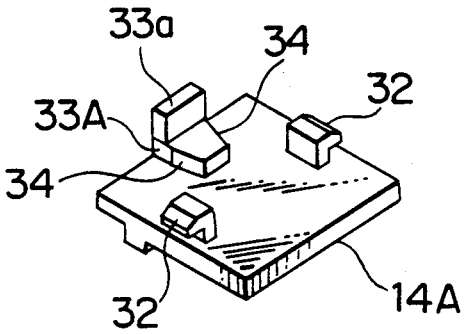
FIG. 16 is a perspective view of a locking device viewed from its rear side showing still another embodiment.
Figure 17:
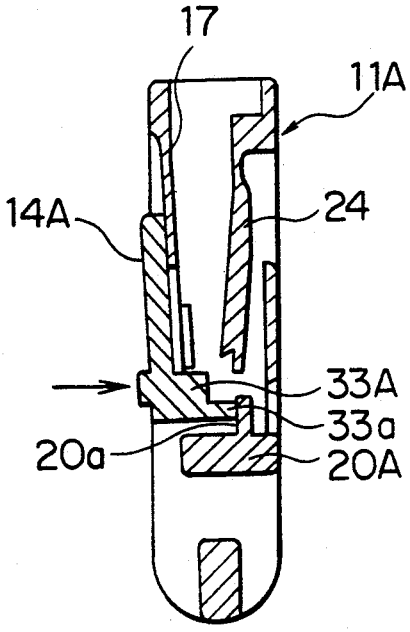
FIGS. 17 and 18 are cross sectional views of a socket showing different operations of a locking device in the embodiment of FIG. 16 respectively.
Figure 18:
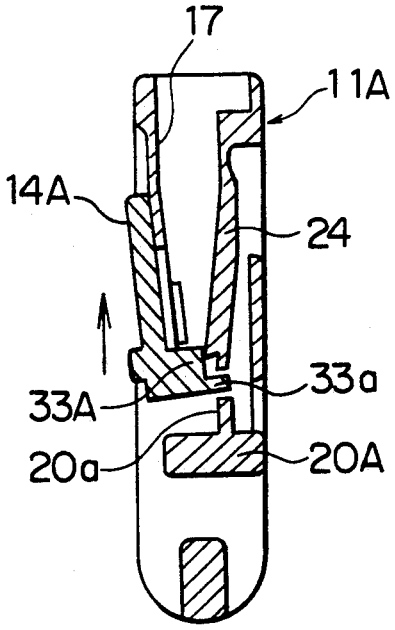

Considering the above mentioned, the modified embodiment of FIGS. 16, 17 and 18 is proposed. According to this embodiment, even if any high pressuring power is applied to a locking-plate 14A of a locking device 1A, the locking-plate 14A is not substantially deformed resiliently toward the resilient engaged member 24 of a socket-body 13A until the locking-plate 14A is slid to almost the predetermined unlocked position. In the modified embodiment, a bevelled pressuring step **33*a* is provided at the bar-side end of the rear face of the pressuring projection 33A so as to be projected toward the resilient engaged member 24 of the socket-body 13A. Then, in order to correspond this pressuring projection 33A having this structure, a receiving step 20*a* is projected at the chamber-side face of a bottom shell 20A of the socket-body 13A** with a predetermined length being determined so as to satisfy the following condition;

When the pressuring projection 33A is located at the bottom shell-side, even if the locking-plate 14A is pressured toward the resilient engaged member 24 of the socket-body 13A, the pressuring step **33*a* can be brought to stop at the receiving step 20*a* and the pressuring projection 33A can not be moved toward the rear shell 23 of the socket-body 13A. On the other hand, when the locking-plate 14A is slid to the inlet-side and it is pressured toward the resilient pressuring member 17, the pressuring step 33*a* of the pressuring projection 33A can be slid to the inlet-side beyond the receiving step 20*a* of the bottom shell 20A and the pressuring projection 33A can be brought into contact with the resilient engaged member 24 of the socket-body 13A**.

Therefore, as shown in FIG. 17, in the socket body 13A of this embodiment, when the locking-plate 14A is not placed at the predetermined unlocked position, even if the locking-plate 14A is pressured with any high pressuring power, the locking-plate 14A can not be deformed resiliently beyond the receiving step **20*a* toward the rear shell 23 of the socket-body 13A. Because, the pressuring step 33*a* of the pressuring projection 33A is brought to stop at the receiving step 20*a* of the bottom shell 20A**.

Then, the locking-plate 14A is slid to the inlet-side 35 of the socket-body 13. In this case, as shown in FIG. 18, the pressuring step **33*a* of the pressuring projection 33A is also slid to the inlet-side beyond the receiving step 20*a*. The pressuring projection 33A moves toward the inlet 35 so as to slide along the resilient engaged member 24 until the predetermined unlocked position. Then, at this unlocked position, the pressuring projection 33A pressures the resilient engaged member 24 toward the rear shell 23 of the socket-body 13A so that the plug 12 is unlocked to be removed from the socket 11A. As a result, according to the socket 11**A of this embodiment, the user is not required to pay attention to his pressuring power for unlocking. That is to say, this buckle is convenient in operation.

This combination of the pressuring step 33*a* of the pressuring projection 33A and the receiving step 20*a* of the bottom shell 20A can be applied to the above mentioned socket 13B, which has the spring mechanism 27.

On the other hand, instead of the spring mechanism 27, locating means might be provided by forming projections or notches on the guide-holes 29, 29 of the socket-body 13, 13A, 13B and the engaging guide-hooks 32, 32 of the locking-plate 14, 14A. 14B so that the pressuring projection 33, 33A, 33B of the locking device 1, 1A, 1B can be stayed at either the locked position or the unlocked position. In this case, the object of the present invention can be also attained sufficiently.

While preferred embodiments have been described, it is apparent that the present invention is not limited to the specific embodiments thereof.

What is claimed is:

1. A buckle having a hollow socket-body and a plug resiliently engaging to and disengaging to be removed from said socket-body, said buckle comprising;

said socket-body, which is built up with an inlet, a front shell, a rear shell, a bottom shell and side shells, which has a resilient pressuring member formed along the peripheral portion of said front shell of said hollow socket-body so as to form a U-shaped slit and which has a resilient engaged member projected from the inlet-side of said rear shell toward said bottom shell to be extended in a hollow chamber in said socket-body and provided with an engaged portion at its fore end portion;

said plug, which is built up with a plug-body and a pair of engaging members extended from said plug-body toward said socket-body and provided with engaging portions at their fore end portions respectively; and a locking device which comprises of a locking-plate and a thick pressuring projection projected from the center of the bottom shell-side end portion of the rear face of said locking-plate and which is attached to said resilient pressuring member to make a socket so that, when said pressuring projection is located at the bottom shell-side, even if said locking-plate is pressured toward said resilient engaged member, said pressuring projection can not be brought into contact with said resilient engaged member, and only when said locking-plate is slid to the inlet-side and is pressured toward said resilient pressuring member, said pressuring projection can be brought into contact with said resilient engaged member to deform resiliently said resilient engaged member toward said rear shell for removing said plug from said socket.

2. A buckle according to claim 1, wherein a spring mechanism is provided by the co-operation of said locking device and said socket-body so that said locking device can be always pressured resiliently toward said bottom shell.

3. A buckle according to claim 2, wherein said spring mechanism is provided by the co-operation of a pair of resilient legs formed in said socket-body; said resilient legs including fore end portions, and side faces of said pressuring projection of said locking device so that the fore end portions of said pair of resilient legs can be brought into contact with said side faces of said pressuring projection while said pair of resilient legs are deformed resiliently.

4. A buckle according to claim 2, wherein said spring mechanism is provided by the co-operation of a pair of resilient legs formed in said pressuring projection of said locking device and a notch having tapered and opposed inner side faces and being formed in said socket-body so that the fore end portions of said pair of resilient legs can be brought into contact with said inner side faces of said notch while said pair of resilient legs are deformed resiliently.

5. A buckle according to any to claims 1 to 3, wherein said pressuring projection of said locking device is provided with a bevelled pressuring step at a bar-side end of a rear face of said pressuring projection so as to be projected toward said resilient engaged member of said socket-body, while said pressuring step is corresponded by a receiving step provided at a chamber-side face of said bottom shell and is projected with a length being determined so that, when said pressuring projection is located at the bottom shell-side, even if said locking-plate is pressured toward said resilient engaged member, said pressuring step can be brought to stop at said receiving step and said pressuring projection can not be moved toward the rear shell of said socket-body, and only when said locking-plate is slid to the inlet-side and is pressured toward said resilient pressuring member, said pressuring step of said locking device can be slid to the inlet-side beyond said receiving step of said bottom shell and said pressuring projection can be brought into contact with said resilient engaged member of said socket-body.

* * * * *